US010105950B2

(12) United States Patent
Muro et al.

(10) Patent No.: US 10,105,950 B2
(45) Date of Patent: Oct. 23, 2018

(54) CONTROL APPARATUS AND CONTROL METHOD

(71) Applicant: CANON KABUSHIKI KAISHA, Tokyo (JP)

(72) Inventors: Kentaro Muro, Tokyo (JP); Minoru Teshigawara, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/669,644

(22) Filed: Aug. 4, 2017

(65) Prior Publication Data

US 2018/0050536 A1 Feb. 22, 2018

(30) Foreign Application Priority Data

Aug. 22, 2016 (JP) ..... 2016-162210

(51) Int. Cl.
*B41J 13/00* (2006.01)
*B41J 2/045* (2006.01)
*B41J 3/60* (2006.01)

(52) U.S. Cl.
CPC ..... *B41J 2/04573* (2013.01); *B41J 2/04586* (2013.01); *B41J 3/60* (2013.01); *B41J 13/0018* (2013.01); *B41J 13/0036* (2013.01)

(58) Field of Classification Search
CPC ..... B41J 2/04573; B41J 3/60; B41J 13/0018; B41J 13/0036; B41J 2/04586
See application file for complete search history.

(56) References Cited

U.S. PATENT DOCUMENTS

2003/0058251 A1* 3/2003 Nakayama ..... H04N 1/00002 345/589

FOREIGN PATENT DOCUMENTS

JP 2000247529 A 9/2000

* cited by examiner

*Primary Examiner* — Yaovi M Ameh
(74) *Attorney, Agent, or Firm* — Canon U.S.A., Inc. IP Division

(57) ABSTRACT

A control apparatus includes an application unit, a conveyance unit, a stacking member, a pressing member, and a control unit. The application unit applies a recording agent to a recording medium, which then is conveyed by the conveyance unit. The stacking member stacks sequentially conveyed recording media with a surface of the recording media to which the recording agent is applied facing up. The pressing member presses the sequentially stacked recording media. The control unit controls timing at which the pressing member contacts the recording media. The pressing member presses an upper surface of the stacked recording medium. The control unit controls the timing at which the pressing member contacts a recording medium when the recording medium has been stacked on the uppermost recording medium, based on data for applying the recording agent to a predetermined area, on the recording medium, including an area which the pressing member can contact.

24 Claims, 12 Drawing Sheets

FIG.7

| IMAGE DETERMINATION SIGNAL | T1 [sec] | T2 [sec] | T3 [sec] | Td [sec] |
|---|---|---|---|---|
| 0 | 0.8 | 0.3 | 0 | 0 |
| 1 | 0.8 | 0.3 | 2.5 | 1.4 |
| 2 | 0.8 | 0.3 | 4 | 2.9 |

CASE OF (T1 + T2) < T3

CASE OF (T1 + T2) ≥ T3

FIG.10A

| IMAGE DETERMINATION SIGNAL | SPEED V [mm/s] | T1 [sec] | T2 [sec] | T3 [sec] | Td [sec] |
|---|---|---|---|---|---|
| 0 | 500 | 0.8 | 0.3 | 0 | 0 |
| | 250 | 1.6 | 0.4 | 0 | 0 |
| | 100 | 4 | 0.7 | 0 | 0 |
| 1 | 500 | 0.8 | 0.3 | 2.5 | 1.4 |
| | 250 | 1.6 | 0.4 | 2.5 | 0.5 |
| | 100 | 4 | 0.7 | 2.5 | 0 |
| 2 | 500 | 0.8 | 0.3 | 4 | 2.9 |
| | 250 | 1.6 | 0.4 | 4 | 2 |
| | 100 | 4 | 0.7 | 4 | 0 |

FIG.10B

| IMAGE DETERMINATION SIGNAL | SPEED V [mm/s] | T1 [sec] | T2 [sec] | T3 [sec] | Td [sec] |
|---|---|---|---|---|---|
| 0 | 500 | 2.3 | 0.3 | 0 | 0 |
| | 250 | 3.1 | 0.4 | 0 | 0 |
| | 100 | 5.5 | 0.7 | 0 | 0 |
| 1 | 500 | 2.3 | 0.3 | 2.5 | 0 |
| | 250 | 3.1 | 0.4 | 2.5 | 0 |
| | 100 | 5.5 | 0.7 | 2.5 | 0 |
| 2 | 500 | 2.3 | 0.3 | 4 | 1.4 |
| | 250 | 3.1 | 0.4 | 4 | 0.5 |
| | 100 | 5.5 | 0.7 | 4 | 0 |

FIG.12

<table>
<tr><th rowspan="2">RECORDING DENSITY [%]</th><th colspan="3">PRINT QUALITY</th></tr>
<tr><th>FAST</th><th>STANDARD</th><th>FINE</th></tr>
<tr><td>0 - 30</td><td>500 mm/s</td><td rowspan="2">250 mm/s</td><td rowspan="3">100 mm/s</td></tr>
<tr><td>30 - 60</td><td>250 mm/s</td></tr>
<tr><td>60 - 100</td><td>100 mm/s</td><td>100 mm/s</td></tr>
</table>

CONTROL APPARATUS AND CONTROL METHOD

BACKGROUND OF THE INVENTION

Field of the Invention

The disclosed information relates to a control apparatus which controls, when recording media onto which a recording agent has been applied are sequentially stacked on a stacking member, timing at which a pressing member contacts the recording media, and a control method therefor.

Description of the Related Art

Conventionally, an apparatus has been known which stacks a plurality of sheets each having an image formed thereon onto a sheet discharge tray and aligns the stacked sheets by lining up their edges with one another.

Japanese Patent Application Laid-Open No. 2000-247529 discusses a configuration in which a paddle rotatably supported by a shaft is rotated and displaced to press an uppermost surface of sheets accommodated in a sheet tray. Thus, a misalignment of a position of the discharged sheet is suppressed, so that the sheets can be accommodated at an accurate position in the sheet tray.

A sheet alignment apparatus discussed in Japanese Patent Application Laid-Open No. 2000-247529 is configured to make an apparatus member directly contact a recording medium. Thus, in a recording system requiring a time period to fix a recording agent to a recording medium such as an ink jet system using liquid ink as a recording agent, when such a type of the sheet alignment apparatus is employed, the apparatus member may contact the recording agent in an unfixed state on the recording medium.

SUMMARY OF THE INVENTION

According to an aspect of the present invention, a control apparatus includes an application unit configured to apply a recording agent to a recording medium, a conveyance unit configured to convey a recording medium to which a recording agent is applied by the application unit, a stacking member configured to stack recording media which are sequentially conveyed by the conveyance unit, a pressing member configured to press the recording media which are sequentially stacked on the stacking member, and a control unit configured to control timing at which the pressing member contacts the recording media, wherein the recording media is stacked on the stacking member with a surface of the recording media to which the recording agent is applied facing up, and the pressing member presses an upper surface of the recording medium stacked on the stacking member, and wherein the control unit controls the timing at which the pressing member contacts a recording medium when the recording medium has been stacked on the uppermost recording medium, based on data for applying the recording agent to a predetermined area, on the recording medium, including an area which the pressing member can contact.

Further features of the present invention will become apparent from the following description of embodiments with reference to the attached drawings.

BRIEF DESCRIPTION OF THE DRAWINGS

FIG. 7 illustrates a time selection table.

FIGS. 10A and 10B each illustrate a time selection table.

FIG. 12 illustrates a conveyance speed selection table.

DESCRIPTION OF THE EMBODIMENTS

An embodiment will be described below with reference to the drawings.

Configuration of Ink Jet Recording Apparatus

Figure 1:
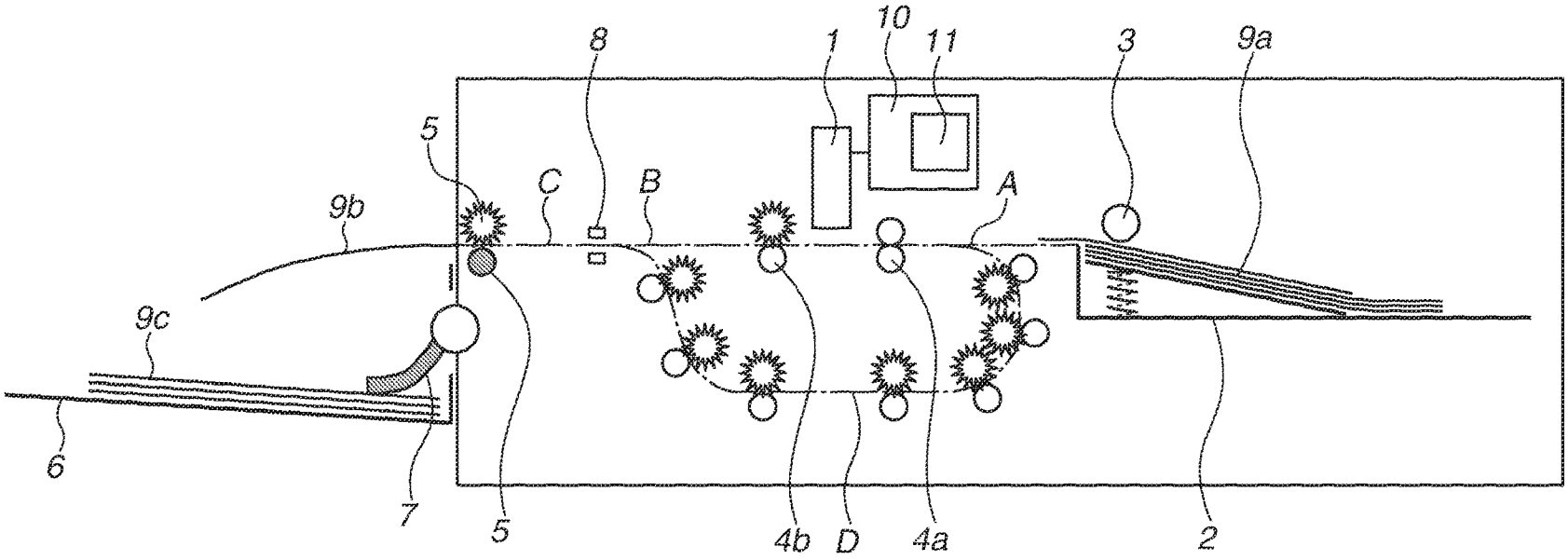
FIG. 1 is a cross-sectional view of an ink jet recording apparatus.

FIG. 1 is a cross-sectional view of a recording apparatus according to the present embodiment. In the present embodiment, an ink jet recording apparatus which forms an image on a recording medium by applying ink as a recording agent will be described as an example. In FIG. 1, the ink jet recording apparatus includes a recording head 1, a sheet feeding cassette 2, a sheet feeding roller 3, conveyance roller 4, a sheet discharge roller 5, a sheet discharge tray 6, and a sheet alignment mechanism. The control unit 10 is connected to the apparatus in such a way as to allow control of a rotation direction and a speed of each roller and further allow control of an operation of the recording head 1 to match conveyance of a sheet (recording medium). The recording head 1 according to the present embodiment is an ink jet head including nozzles (discharge ports) which discharge ink. A pair of rollers provided from the recording head 1 to the sheet discharge roller 5 includes a spur roller and a rubber roller, and the recording head 1 causes the spur roller to contact a surface of a sheet onto which ink is applied. Since a spur roller having a small sheet contact area is used, soiling and image distortion by transferred ink in an unfixed state on a recording surface can be made unnoticeable. The sheet discharge tray 6 is a stacking member. Sheets are sequentially conveyed after an image has been formed, and sequentially stacked on the tray 6. The sheet alignment mechanism includes a rubber piece 7 serving as a pressing member for pressing the sheet stacked on the sheet discharge tray 6 and its rotating shaft 13. Such a configuration and its driving will be described below.

The ink jet recording apparatus according to the present embodiment supports double-side printing for applying ink to both surfaces of a sheet. When one-sided printing for performing printing on only one surface of a sheet is carried out, a sheet 9*a* picked up by the sheet feeding roller 3 from the sheet feeding cassette 2 is conveyed by the conveyance roller 4, and an image is formed thereon by the recording head 1. Further, a sheet sensor 8 is provided downstream of the recording head 1. When the sheet sensor 8 detects that a trailing edge of the sheet 9*a* has passed therethrough, a sheet passage signal is fed to the control unit 10. The sheet 9*b* having the image formed thereon is conveyed by the conveyance roller 4 and the sheet discharge roller 5, and then stacked on the sheet discharge tray 6.

When double-side printing for performing printing on both surfaces of the sheet 9*a* is carried out, an image is first formed on a first print surface by the recording head 1. When the sheet sensor 8 detects that the sheet having an image formed on its first print surface has passed through a predetermined position, the control unit 10 receives a sheet passage signal from the sheet sensor 8. Consequently, the control unit 10 stops the sheet discharge roller 5 at timing that a trailing edge of the sheet reaches a spot C short of the sheet discharge roller 5. Then, the sheet discharge roller 5 is reversed to return the sheet 9*a* to a spot B. At the spot B, a conveyance path is switched by a flapper (not illustrated), and the sheet is conveyed to reach a spot A via a spot D. Thus, the front and back of the sheet are reversed. Then, an image is formed using the recording head 1 on a second print surface which is a rear surface of the first print surface, and sheets are discharged like at the time of one-sided printing, and are sequentially stacked on the sheet discharge tray 6.

In the present embodiment, an ink jet recording apparatus having a so-called face-up sheet discharge configuration in which a sheet is discharged to the sheet discharge tray 6 with its surface having an image formed thereon directed upward will be described. In the case of the face-up sheet discharge, when a member of a sheet alignment mechanism directly contacts ink on its sheet surface and presses the sheet, there is a risk that the ink is transferred onto the member in the sheet alignment mechanism, and the image on the sheet surface is at a risk of being distorted. On the other hand, in an ink jet recording apparatus having a so-called face-down sheet discharge configuration in which a sheet is discharged with its surface having an image formed thereon directed downward, a member of a sheet alignment mechanism does not directly contact ink on the sheet. However, the sheet is pressed from a rear surface side of the surface having the image formed thereon. Thus, a sheet already stacked on the sheet discharge tray 6 is at risk of being soiled, or the sheet is at a risk of being soiled by the ink rubbed on the sheet discharge tray 6. More specifically, while in the two device configurations, objects to be soiled are different, it is possible in both configurations that the soiling with unfixed ink may occur. An embodiment is directed to suppressing such soiling with unfixed ink, and is applicable to both device configurations. An embodiment also is applicable to a recording apparatus which records an image using a recording agent other than ink as long as the recording apparatus suppresses the soiling with an unfixed recording agent, which is an issue to be addressed.

Structure of Sheet Alignment Mechanism

Figure 2:
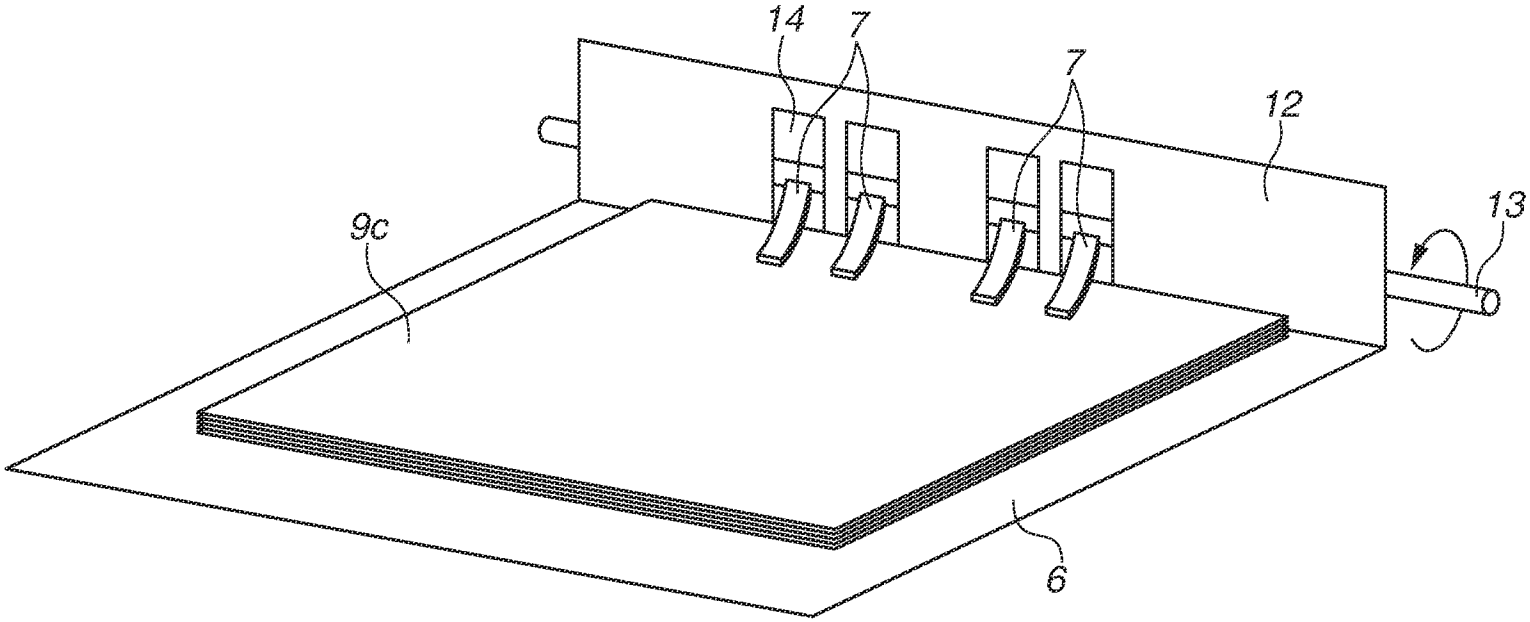
FIG. 2 illustrates a configuration of a sheet alignment mechanism.

FIG. 2 illustrates a configuration of the sheet alignment mechanism. In FIG. 2, the sheet alignment mechanism includes four rubber pieces 7 fixed to the rotating shaft 13. The number of rubber pieces 7 is not limited to four. An opening 14 is provided to match position of the rubber pieces 7 on a wall 12 so that the rubber pieces 7 are freely rotatable as the rotating shaft 13 is driven to rotate. When a driving force of a pulse motor (not illustrated) is transmitted to a gear group, the rotating shaft 13 can be rotated. An engine control unit 407 illustrated in FIG. 4A can stop the rubber piece 7 at a predetermined angle by controlling the number of driving pulses of the pulse motor. The rubber piece 7 is elastically deformed when pressed against a sheet in such a way that its side contacting the sheet is convexly curved. The sheet alignment mechanism is configured such that the sheet is pulled back toward the wall 12 when the rubber piece 7 is rotated and curved. The sheet on the sheet discharge tray 6 is aligned when a trailing edge of the sheet abuts on the wall 12. An example of the sheet alignment mechanism is not limited to the configuration illustrated in FIG. 2. While a material for the rubber piece 7 serving as the pressing member is a rubber material according to the present embodiment, the material is not limited to the rubber material as long as it can press the sheet. However, the pressing member is composed of an elastic member. The weight of the one pressing member is 10 g to 60 g, and the coefficient of friction thereof is 0.2 or more so that the sheet is not too much pulled back.

Operation of Sheet Alignment Mechanism

A method for operating the sheet alignment mechanism to align sheets will be described with reference to FIG. 3. The sheets each having an image formed thereon are sequentially conveyed, are discharged onto the sheet discharge tray 6, and are stacked thereon. The N-th sheet which is discharged after the image has been formed thereon, is hereinafter referred to as a sheet [N]. FIGS. 3A to 3D each illustrate the order of operations of the sheet alignment mechanism for the sheets preceding and succeeding the sheet [N].

Figure 3A:
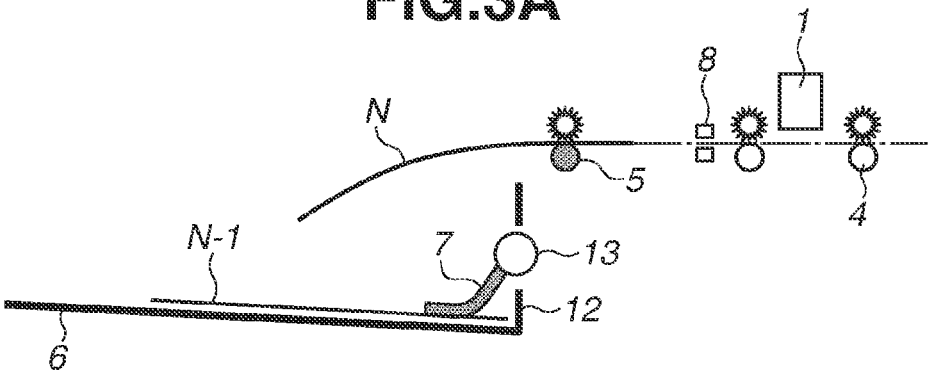
FIGS. 3A to 3D each illustrate the order of operations of a recording medium alignment mechanism.

FIG. 3A illustrates a state where the sheet [N−1] has already been stacked on the sheet discharge tray 6 and subsequently, the sheet [N] is being discharged thereon. The sheet [N−1] remains pressed by the rubber piece 7. The rubber piece 7 presses the sheet [N−1] before the sheet [N] contacts the sheet [N−1]. Therefore, the sheet [N−1] is not ejected in a discharge direction with a frictional force produced with the sheet [N].

Figure 3B:
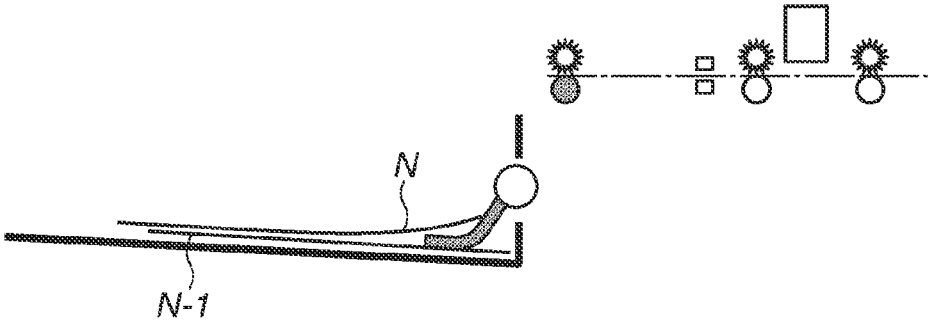

FIG. 3B illustrates a state where the entire sheet [N] has been discharged onto the sheet [N−1], i.e., onto the uppermost sheet in the sheet discharge tray 6, dropping under its own weight. In this state, the sheet [N] is not pressed by the rubber piece 7, so that the sheet [N] is not soiled with ink.

Figure 3C:
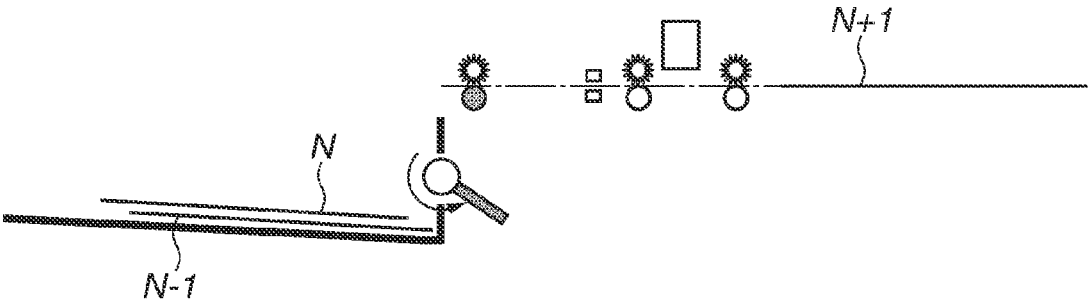

FIG. 3C illustrates a state where the rotating shaft 13 is being rotated. When the rubber piece 7 is pulled out from below the sheet [N], a trailing edge of the sheet [N] drops on the sheet [N−1] under its own weight.

Figure 3D:
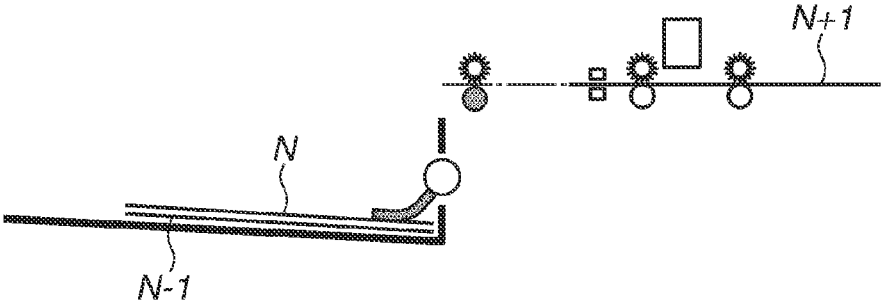

FIG. 3D illustrates a state obtained by rotating the rubber piece 7 once from the state illustrated in FIG. 3B, where the sheet [N] abuts on the wall 12 by friction between the rubber piece 7 and the sheet [N]. More specifically, the sheet [N] remains aligned with the sheet [N−1]. By a series of changes illustrated in FIGS. 3A to 3D, the sequentially stacked sheets can be aligned.

Figure 4A:
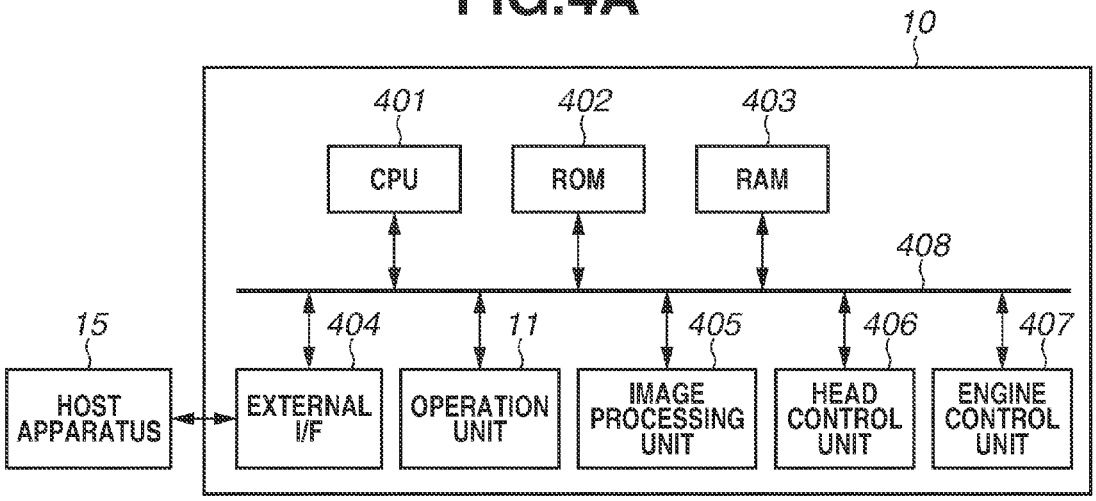
FIGS. 4A and 4B are block diagrams each illustrating a control unit.

FIG. 4A is a block diagram illustrating the concept of the control unit 10. The control unit 10 includes a central processing unit (CPU) 401, a read-only memory (ROM) 402, a random access memory (RAM) 403, an image processing unit 405, a head control unit 406, and an engine control unit 407. The CPU 401 integrally controls an operation of each unit in the recording apparatus. The ROM 402 stores a program to be executed by the CPU 401 and fixed data required for various types of operations performed by the recording apparatus. The RAM 403 is used as a work area of the CPU 401, or used as a temporary storage area of various types of received data. The RAM 403 stores various types of setting data. The operation unit 11 is an input/output interface with a user. The operation unit 11 includes an input unit such as a hard key or a touch panel and an output unit such as a display which presents information and a voice generator.

A dedicated processing unit is provided in the unit requiring high-speed data processing. The image processing unit 405 performs image processing for image data handled by the recording apparatus. A color space (e.g., YCbCr) of input image data is converted into a standard RGB color space (e.g., sRGB). The image data is subjected to various types of image processing such as resolution conversion, image analysis, and image correction, as needed. Record data obtained by the image processing is stored in the RAM 403. The head control unit 406 performs control to drive the recording head 1 in response to the record data based on a control command received from the CPU 401. An engine control unit 407 controls a conveyance mechanism of each unit and sheet feeding and discharge units in the recording apparatus. The engine control unit 407 controls an operation of each unit based on the control command issued by the CPU 401. The external I/O 404 is an interface (I/F) for connecting the control units to the host apparatus 15, and is a local I/F or a network I/F. The above-described components are connected to one another by a system bus 408.

The host apparatus 15 is an apparatus serving as a supply source of image data to cause the recording apparatus to perform recording. The host apparatus 15 may be a general-purpose or dedicated computer, or may be dedicated imaging equipment such as an image capture, a digital camera, or a photo-storage including an image reader unit. When the host apparatus 15 is a computer, an operating system (OS), application software for generating image data, and a printer driver for a printing apparatus are installed into a storage device included in the computer. It is not essential that all the above-described processes are implemented by software, but some or all of the processes may be implemented by hardware.

Method for Suppressing Soiling

A method for inhibiting the sheet [N] from being soiled will be described below. In the present embodiment, timing at which the rubber piece 7 is driven is controlled such that ink applied to the sheet [N] from the recording head 1 has been fixed before the rubber piece 7 contacts the sheet [N].

Figure 4B:
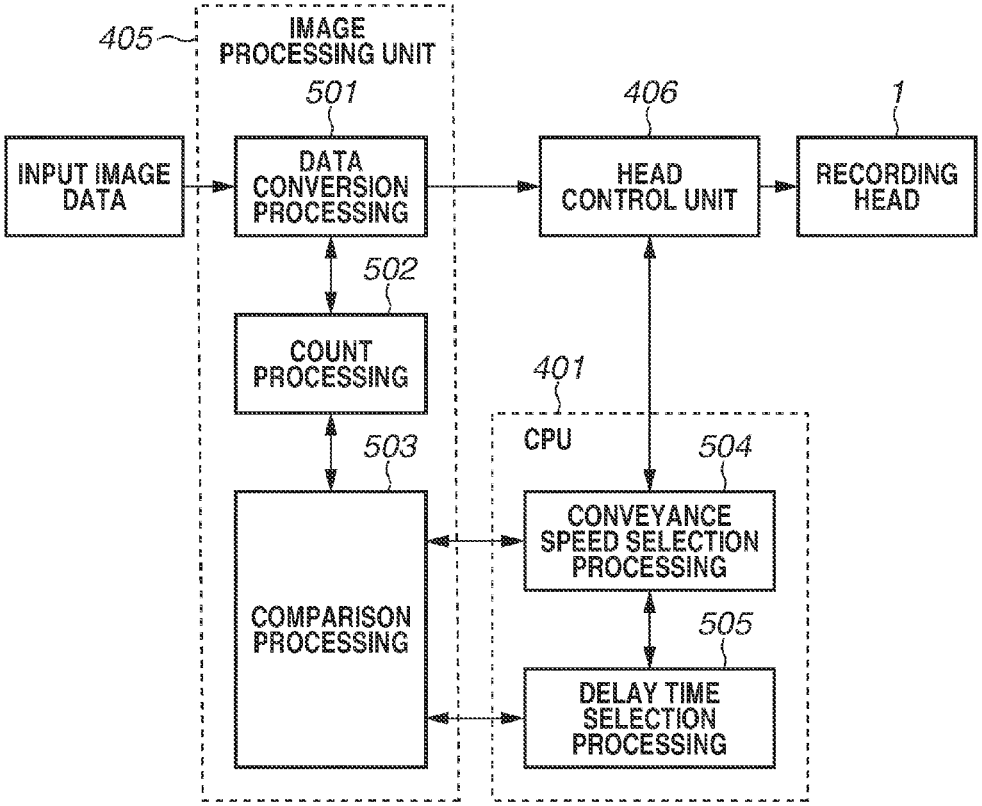

FIG. 4B is a block diagram illustrating processing for an input image. In FIG. 4B, in data conversion processing 501 performed in the image processing unit 405, multivalued image data such as RGB multivalued image data is converted into binary image data representing discharge or non-discharge of ink droplets from the recording head 1. In count processing 502, the number of ink droplets discharges onto a predetermined area on a sheet is counted based on the binary image data. In comparison processing 503, the counted number of times of discharge is compared with a threshold value as magnitude relation. The image processing unit 405 is preferably configured by a dedicated logic circuit because it requires high-speed processing. In conveyance speed selection processing 504, a sheet conveyance speed is selected depending on information about a print quality selected by the user and information about a recording density of an image. The processing 504 is performed by the CPU 401, and the conveyance speed is selected with reference to a conveyance speed selection table previously stored in the ROM 402. FIG. 12 illustrates the conveyance speed selection table. In FIG. 12, the print quality is divided into three stages, i.e., "fast", "standard", and "fine", and the recording density is divided into three stages using 30% and 60% as threshold values. "0-30", "30-60", and "60-100" respectively indicate that the recording density is less than 30%, 30% or more and less than 60%, and 60% or more and 100% or less. If the recording density is "40%" and the print quality is "fast", for example, "250 mm/s" is selected. The user can select the print quality from the printer driver in the host apparatus 15 or the operation unit 11. Information about the recording density is calculated after the input image data is analyzed in the image processing unit 405. Delay time selection processing 505 is used to acquire an image determination signal (details of which will be described below) output in the comparison processing 503 and determine the time when the rubber piece 7 starts to rotate. The CPU 401 performs the processing.

Figure 5:
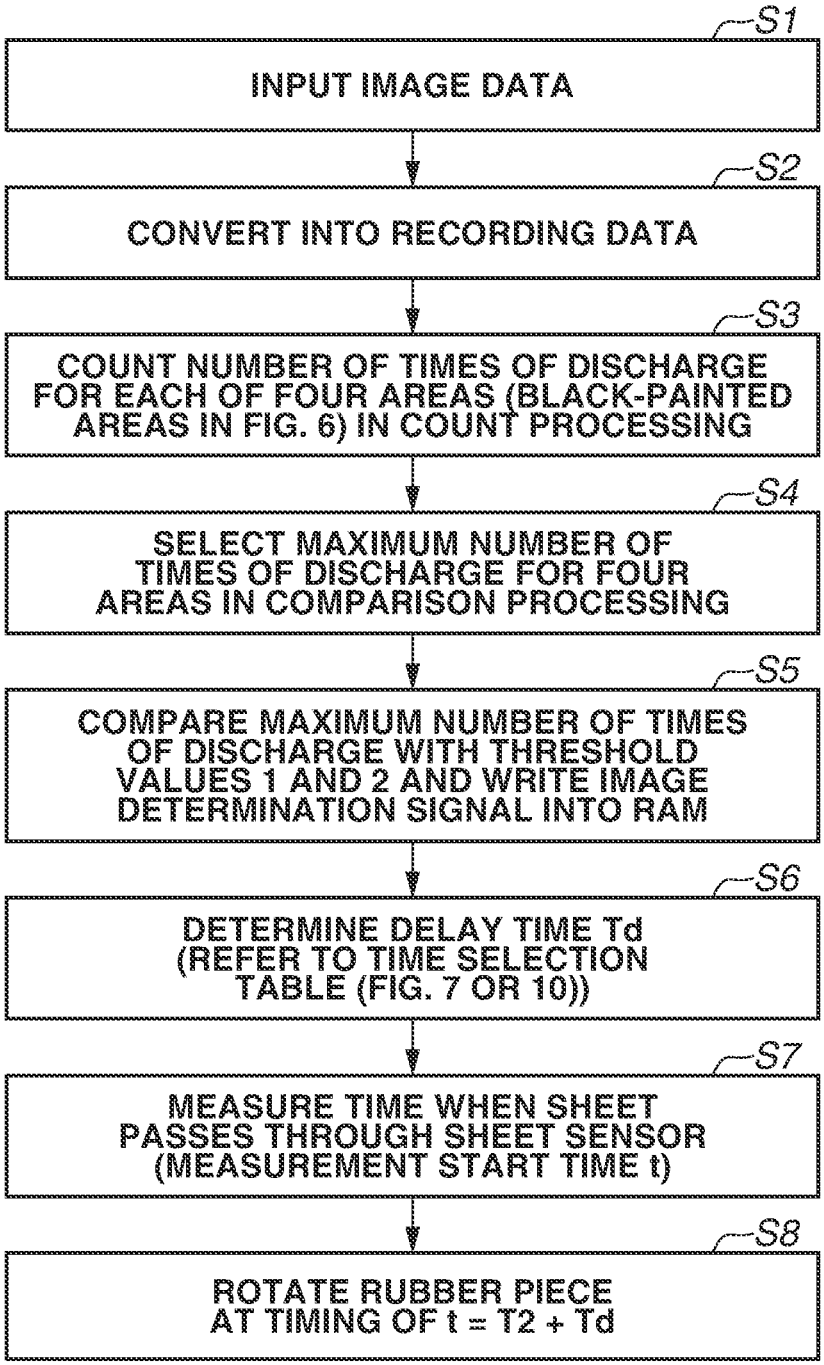
FIG. 5 illustrates a control flow.

FIG. 5 is a control flowchart. In step S1, the CPU 401 first inputs image data into an image input unit. In step S2, the CPU 401 causes a data conversion circuit for forming an image with the recording head 1, to convert the input image data into recording data indicating how many times ink droplets are to be discharged for each recording pixel. In step S3, the CPU 401 counts in the count processing 502 how many times ink droplets are to be discharged onto a predetermined area on a sheet surface based on the recording data, to acquire the number of times of discharge.

Figure 6A:
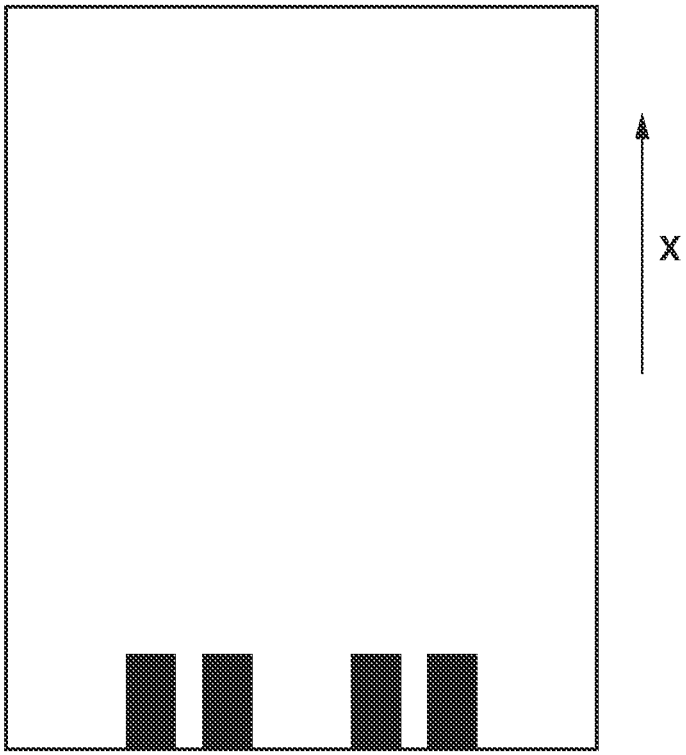
FIGS. 6A and 6B each illustrate an area where the number of times of discharge is counted.

FIG. 6A illustrates an area where the number of ink droplet discharges is counted in recording data. An arrow X indicates a conveyance direction of a sheet when image formation is performed using the recording head 1. A black-painted area is an area where the number of times of discharge is counted, and can be previously defined as an area which the rubber piece 7 can contact. When the sheet is discharged, the area where the number of times of discharge is counted is preferably set larger by approximately several millimeters leftward, rightward, upward, and downward than the area which the rubber piece 7 contacts, considering that a position of the sheet shifts leftward, rightward, upward and downward from the rubber piece 7. If the area which the rubber piece 7 contacts is 15 mm in length and 7 mm in width, for example, the area where the number of times of discharge is counted is set to be 25 mm in length and 15 mm in width to include the area which the rubber piece 7 can contact and an area in its 4 to 5 mm vicinity.

In steps S4 and S5, the CPU 401 compares in the comparison processing 503 the number of discharges obtained by counting the recording data corresponding to a predetermined area and previously determined threshold values 1 and 2 in two stages. In the present case, a relationship of threshold value 2>the threshold value 1 is assumed to hold, and the threshold value 1 and the threshold value 2 are respectively set to 206500 and 413000 times of discharge. The numerical values are previously adjusted depending on not only the size of the area where the number of discharges of ink droplets is counted but also an amount of the ink droplets for one-time discharge. The number of times of discharge is counted for each of four areas in the present embodiment, and the largest one among the four counted numbers of times of discharge is compared with the threshold values. If the maximum counted number of times of discharge is larger than the threshold value 1 as a result of the comparison, "1" is written into the RAM 403 as an image determination signal. If the maximum counted number of times of discharge is larger than the threshold value 2, is written as an image determination signal. If the maximum counted number of times of discharge is the threshold value 1 or less, "0" is written as an image determination signal. The determination processing is performed in units of pages, sheet by sheet, for an image to be recorded on the sheet. Any one of 0, 1, and 2 is written as an image determination signal from an image determination unit for each of the image pages. In step S6, the CPU 401 refers to a time selection table, which is described below, to determine a "delay time Td" based on the set conveyance speed and a value of the image determination signal.

FIG. 7 illustrates an example of the time selection table according to the present embodiment. The time selection table is stored in the ROM 402. The CPU 401 performs processing for selecting the delay time Td from the value of the image determination signal in the delay time selection processing 505. T1 to T3 described in the time selection table are respectively times defined as follows. T1 is a time period during which a sheet is conveyed from a position opposing the recording head 1 to the sheet sensor, and T2 is a time period which elapses since the sheet passes through the sheet sensor until the sheet is discharged onto the sheet discharge tray 6. That is, (T1+T2) is a conveyance time period which elapses since ink is applied by the recording head 1 until the sheet is discharged onto the sheet discharge tray 6. The time periods T1 and T2 can be previously obtained from designed values of a conveyance speed and a conveyance distance of the sheet. T3 is a time period which elapses since ink is applied to the sheet from the recording head 1 until the ink on the sheet is fixed (a state where the ink does not transfer even if the sheet is pressed by the rubber piece 7). The time period T3 can be previously set corresponding to the image determination signal based on the fixing performance of the ink onto the sheet. In the present embodiment, the time period T3 is set as follows. The time period T3 is 0 sec, 2.5 sec, and 4 sec, respectively, when the image determination signal is "0", "1", and "2". The length of the time period T3 set when the image determination signal is "2" is larger than the length of the time period T3 set when the image determination signal is "1" because the larger an amount of ink applied to the sheet is, the longer it takes until the fixing of the ink ends.

To prevent the rubber piece 7 from being soiled by contacting the sheet, a rotation start timing needs to be controlled such that the rubber piece 7 is rotated after the fixing of the ink applied to the sheet is completed. The rubber piece 7 is rotated immediately after the sheet is discharged onto the sheet discharge tray 6 in a normal case. In this case, a delay time Td by which a rotation timing is delayed can be set from Td=T3−(T1+T2). More specifically, if the time period T3 which elapses since the ink is applied to the sheet until the ink is fixed is longer than the time period (T1+T2) which elapses until the sheet is conveyed from a position of the recording head 1 to the sheet discharge tray 6, timing at which the rubber piece 7 is driven needs to be controlled such that the delay time Td is given. More specifically, if T3>T1+T2, a predetermined time period during which rotation driving of the rubber piece 7 is delayed is set.

Figure 8A:
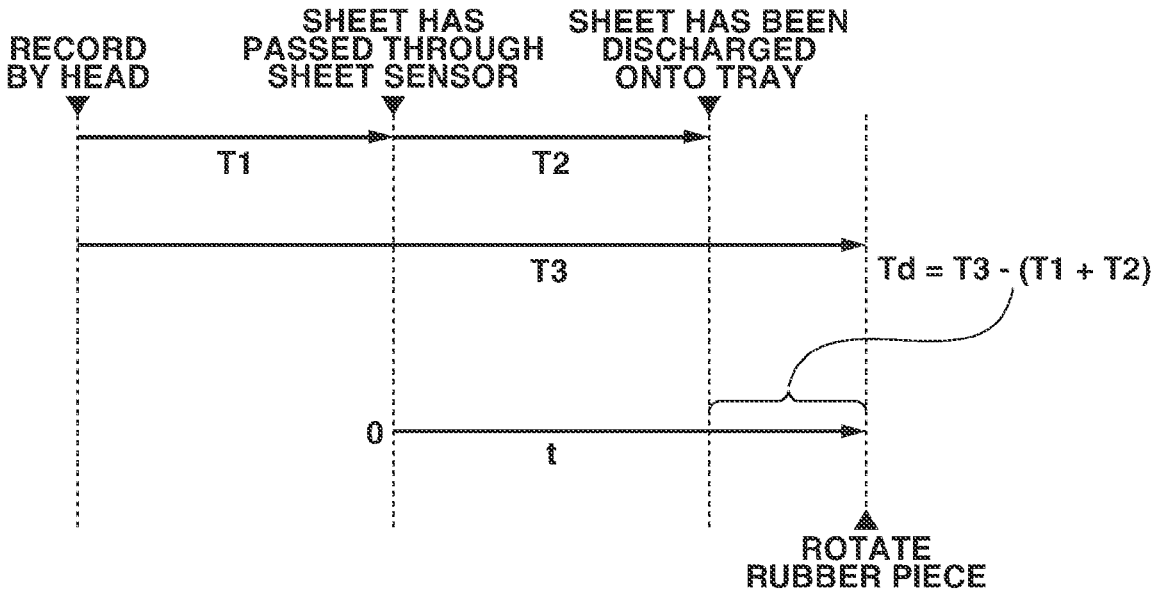
FIGS. 8A and 8B each illustrate a relationship between a sheet conveyance time period and a delay time.
Figure 8B:
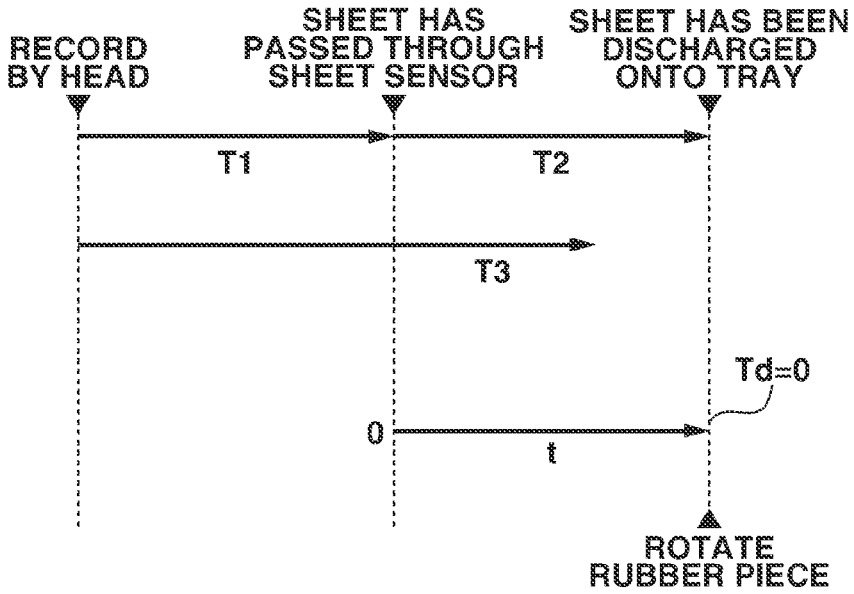
Figure 9A:
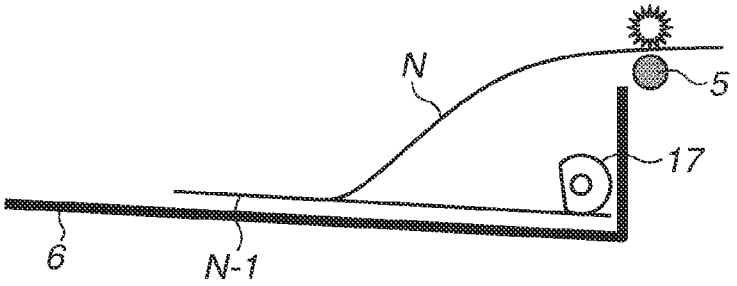
FIGS. 9A to 9D each illustrate another example of the sheet alignment mechanism.
Figure 9B:
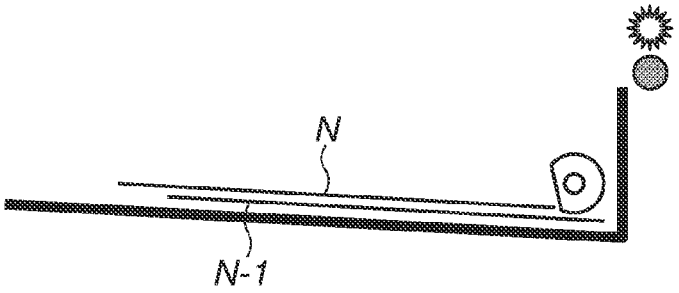
Figure 9C:
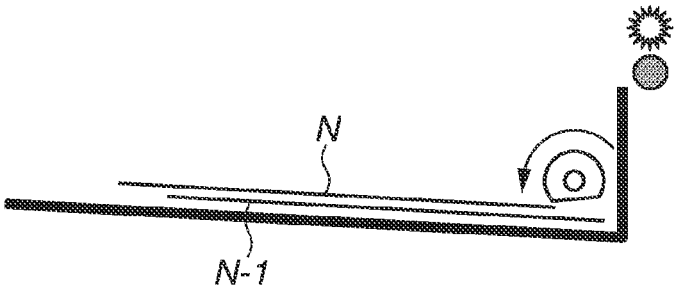
Figure 9D:
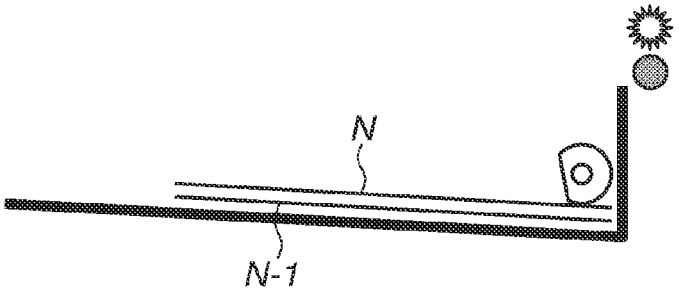

FIG. 8 illustrates a relationship between each of the time periods T1 to T3 and the delay time Td. FIG. 8A illustrates a case where T3>T1+T2, and FIG. 8B illustrates a case where T3≤T1+T2. In the case illustrated in FIG. 8A, the delay time Td is set to satisfy Td=T3−(T1+T2)>0. In the case illustrated in FIG. 8B, the delay time Td is set to satisfy Td=0 because the fixing of the ink has ended before the sheet is discharged onto the sheet discharge tray 6 and the sheet is not soiled even if the driving of the rubber piece 7 is not delayed.

Referring to FIG. 5 again, in step S7 subsequent to step S6, the control unit 10 measures the time from when the sheet passes through the sheet sensor as a measurement start time t. If the driving of the rubber piece 7 is not delayed, i.e., Td=0 is set, the rubber piece 7 is rotated at the timing of t=T2. If the driving of the rubber piece 7 is delayed, i.e., Td>0 is set, the rubber piece 7 is rotated at the timing of t=T2+Td. Through the foregoing processing, even if the rubber piece 7 presses the sheet [N], the sheet [N] is not soiled, and the sheets can be aligned in the state illustrated in FIG. 3D.

Conveyance Timing Control of Succeeding Sheet [N+1]

If the driving of the rubber piece 7 is not delayed, the control unit 10 starts to print the sheet [N], and then starts to feed the succeeding sheet [N+1] at predetermined timing. For example, when the sheet [N] passes through the sheet sensor, the succeeding sheet [N+1] starts to be fed. On the other hand, if the driving of the rubber piece 7 for the sheet [N] is delayed by the delay time Td using the above-described method, a delay time also needs to be given during conveyance for the succeeding sheet [N+1]. For example, after the sheet feeding roller 3 feeds the succeeding sheet [N+1], the rotation of the conveyance roller 4 is stopped, and waits the delay time Td short of the conveyance roller 4. Alternatively, timing at which the sheet feeding roller 3 starts to feed the succeeding sheet [N+1] may be delayed by the delay time Td compared with normal. Thus, the succeeding sheet [N+1] is discharged before the sheet [N] is pressed by the rubber piece 7 so that the sheet [N] can be prevented from being frictionally ejected forward from the sheet discharge tray 6.

Another Form of Sheet Alignment Mechanism

FIG. 9 illustrates an example of another configuration of the sheet alignment mechanism. In FIG. 9, a rotating body 17 the circumference of which has been partially notched is installed at back-end of the sheet discharge tray 6. FIG. 9A illustrates a state where a sheet [N] has been discharged onto a sheet [N−1]. While the sheet [N] is being discharged, the circumference of the rotating body 17 remains pressed by contacting the sheet [N−1] so that the sheet [N−1] is not ejected toward a front end of the sheet discharge tray 6 even if it receives a frictional force from the sheet [N]. Then, FIG. 9B illustrates a state where the sheet [N] has dropped on the sheet [N−1]. At this time, a trailing edge of the sheet remains thrust into a space formed by a notch of the rotating body 17. FIG. 9C illustrates a state where the rotating body 17 is rotating after the sheet [N] has dropped. When the circumference of the rotating body 17 contacts the trailing edge of the sheet [N], the sheet [N] is pulled back toward the wall 12 while the rotating shaft 17 is rotated. FIG. 9D illustrates a state after the rotating shaft 17 is further rotated by approximately 270° from the state illustrated in FIG. 9C. Thus, the sheet [N] is aligned after abutting on the wall 12. Also in such a sheet alignment mechanism, when timing at which the rotating body 17 is driven is controlled, the sheet can be prevented from being soiled by unfixed ink, similar to the configuration illustrated in FIG. 3.

While the number of discharges of ink droplets applied to a predetermined area including an area which the rubber piece 7 contacts on the sheet [N], is counted according to the present embodiment, the embodiments are not limited to this configuration. A time period T3 which elapses until ink applied to the area is fixed to a sheet can be obtained from an amount of the ink, so that a delay time Td can be set. For example, instead of counting the number of discharges of ink droplets from the above-described binary image data, the time period T3 may be set based on multivalued image data before conversion into binary image data. A relationship between the multivalued image data and the time period T3 may be previously obtained, and the delay time Td may be set based on the multivalued image data. At this time, if a plurality of rubber pieces contacts the sheet, the delay time Td should be set based on image data in an area where the amount of applied ink is the largest. For example, the delay time Td can be set based on image data in an area where a total value of multivalued image data is the largest. If ink droplets can be discharged based on multivalued image data larger than binary image data, as in a case of a piezo-type recording head capable of changing the size of ink droplets, the number of discharges also can be counted from the multivalued image data. As described above, the delay time Td can be set based on the image data corresponding to the amount of the ink applied to the area which the rubber piece 7 contacts, on the sheet. While the fixing time period has been estimated based on the amount of the ink applied to the area which the rubber piece 7 can contact according to the present embodiment, the fixing time period may be determined by more finely dividing the area. For example, the fixing time period may be obtained by dividing the area which the rubber piece 7 contacts into unit areas and based on a maximum value of an amount of ink applied to each of the unit areas. Since in the above-described embodiment, the sheet alignment mechanism includes the plurality of rubber pieces 7 and a plurality of areas which the rubber pieces 7 contact, the fixing time period may be obtained based on a maximum value of the amount of the ink applied to the unit area among the plurality of contact areas.

A second embodiment will be described below. In the present embodiment, a method for setting a delay time in a recording apparatus capable of setting a plurality of sheet conveyance speeds will be described. When the delay time is uniformly set regardless of the conveyance speed as in the first embodiment, the delay time is excessively delayed compared to a time period T3 essentially required for fixing if the conveyance speed is low, thereby deteriorating a printing speed. On the other hand, if the conveyance speed is high, the delay time becomes insufficient so that a recorded image and a device member may be soiled. Factors changing the conveyance speed include a case where a print quality has been set by a user and a case where an image of a density exceeding a predetermined recording density has been input to restrict power consumption of a recording head. In this case, a value of the selected conveyance speed is temporarily written into a RAM 403. When a delay time Td is determined in step S6 illustrated in FIG. 5, the delay time Td is selected based on a value of a conveyance speed of a sheet [N] in addition to an image determination signal.

FIG. 10A illustrates a time selection table used in the present embodiment. Driving of a rubber piece 7 is controlled such that a delay time Td becomes short when a conveyance speed is low even if an image determination signal takes the same value. If the image determination signal is 1, for example, a delay time Td (=0.5 sec) when a speed V is 250 mm/s is set shorter than a delay time Td (=1.4 sec) when the speed V is 500 mm/s. A minimum value of the delay time Td is 0 sec. When the delay time is thus set in consideration of the conveyance speed, a sheet can be prevented from being soiled with unfixed ink without reducing printing throughput.

A third embodiment will be described below. In the present embodiment, a method for preventing a sheet from being soiled with unfixed ink will be described when double-side printing is performed. When the double-side printing is performed, two items, i.e., (1) an image area which a rubber piece 7 contacts, and (2) a shortest time period which elapses since printing is performed until the rubber piece 7 contacts the image area on a first print surface, are different from one-side printing. Printing is first performed on the first print surface.

Figure 6B:
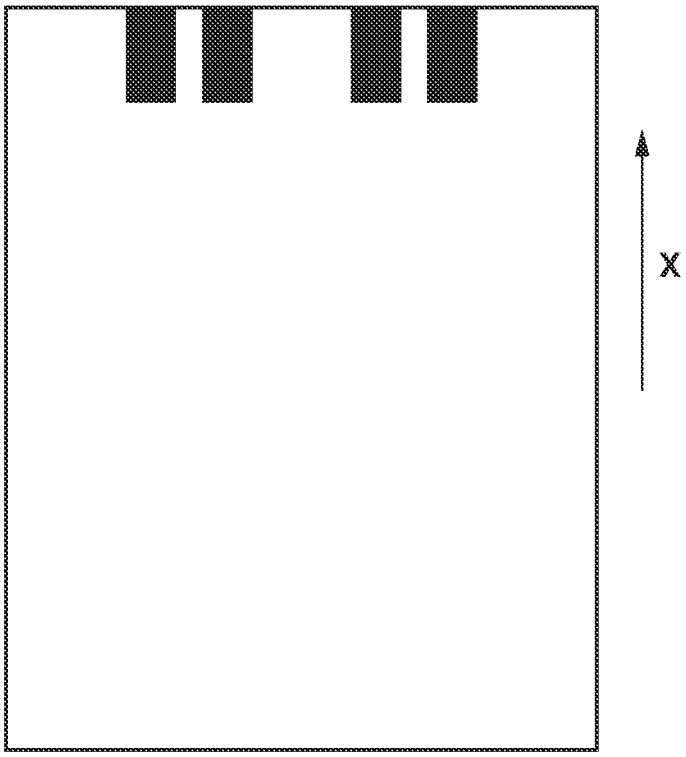

The first item (1) will be described below. In the present embodiment, an area on the first print surface where the number of discharges of ink droplets is counted, is illustrated in FIG. 6B. An arrow X indicates a conveyance direction of the sheet when an image is formed on the sheet by a recording head 1. When the double-side printing is performed, the rubber piece 7 contacts a second print surface. Therefore, an area on the reverse side of the first print surface is pressed. When the one-side printing is performed, an area which the rubber piece 7 contacts when the sheet is discharged onto a sheet discharge tray 6, is positioned on the side of a trailing edge of the sheet in the conveyance direction, as illustrated in FIG. 6A. On the other hand, when the double-side printing is performed, an area on the first print surface which is pressed by the rubber piece 7, is on the side of a leading edge of the sheet in the conveyance direction, as illustrated in FIG. 6B. A direction of the sheet on the second print surface at the time of the double-side printing is similar to that at the time of the one-side printing, and an area which the rubber piece 7 contacts is on the side of the trailing edge of the sheet, as illustrated in FIG. 6A.

The item (2) will be described below. When the double-side printing is performed, a front surface and a rear surface of the sheet are reversed after the image has been formed on the first print surface, and the sheet is discharged onto the sheet discharge tray 6 after the image has been formed on the second print surface. Thus, a time period T1 which elapses since ink is applied to the first print surface until the sheet passes through a sheet sensor, is physically longer than when the one-side printing is performed. Therefore, a time period required for fixing can get longer by a time difference between the respective time periods T1, so that a delay time Td can be set short. FIG. 10B is a delay time selection table for the first print surface at the time of double-side printing. In FIG. 10B, a time period (1.5 sec.) during which the sheet is reversed after passing through a path D illustrated in FIG. 1 is added to a time period T1 illustrated in FIG. 10A. Therefore, the delay time Td differs from that illustrated in FIG. 10A.

Figure 11:
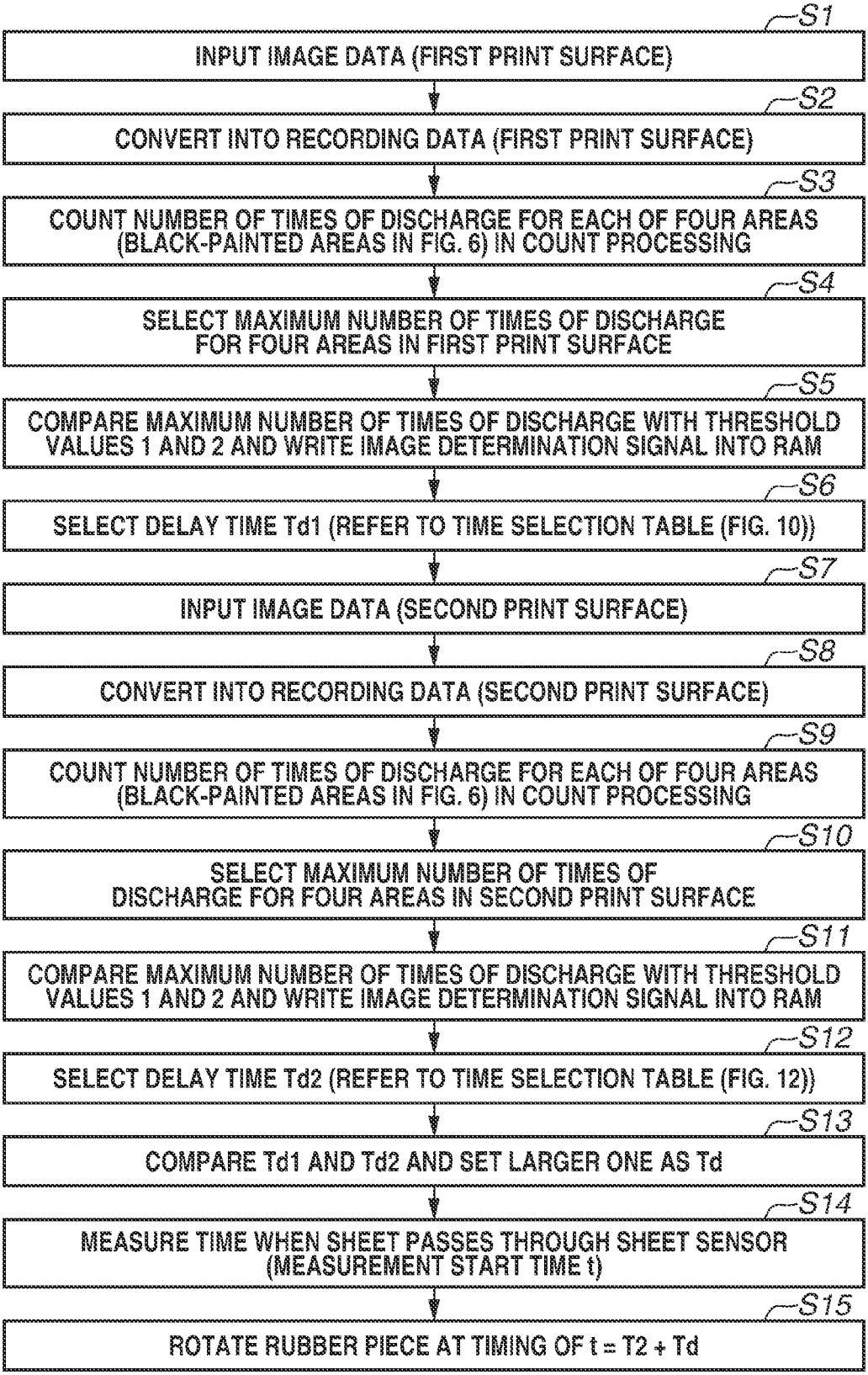
FIG. 11 illustrates a control flow at the time of double-side printing.

When timing at which the rubber piece 7 is driven for the sheet discharged after the double-side printing, is set according to the print surface requiring the longer delay time, the sheet can be prevented from being soiled with unfixed ink based on both image data on the first print surface and image data on the second print surface. FIG. 11 is a control flow at the time of double-side printing. In FIG. 11, in steps S1 to S6, a CPU 401 selects a delay time Td1 for the first print surface. Processing in steps S1 to S6 is similar to the processing in steps S1 to S6 described with reference to FIG. 6 according to the first embodiment. Then, in steps S7 to S12, the CPU 401 selects a delay time Td2 for the second print surface. Processing in steps S7 to S12 may be performed like the processing for the first print surface while there is a difference in that the front side or back side of the sheet is processed. The processing in steps S7 to S12 may be performed like the processing in steps S1 to S6 illustrated in FIG. 11. In step S3, an image area where the number of discharges is counted on the first print surface, is four black-painted areas in FIG. 6B. In step S9, an image area where the number of discharges is counted on the second print surface, is four black-painted areas in FIG. 6A. For the delay times Td1 and Td2, respectively different time selection tables are referred to. According to the present embodiment, FIG. 10A and FIG. 10B are respectively referred to for the delay times Td1 and Td2. In step S13, the CPU 104 compares the delay times Td1 and Td2 with each other, and sets the longer one as a delay time Td. In step S14, when the CPU 104 ends printing on the second print surface and the sheet has passed through the sheet sensor, in step S15, the CPU 104 drives the rubber piece 7 to rotate at timing of t=T2+T1.

Thus, when the double-side printing is performed, it is necessary to consider that not only an area which the rubber piece 7 contacts but also an area on the reverse side is pressed by the rubber piece 7. In the present embodiment, timing at which the rubber piece 7 is driven is controlled in consideration of a fixing time in both of the areas. Thus, the sheet can be prevented from being soiled with unfixed ink at the time of double-side printing.

A fourth embodiment will be described below. In the above-described embodiments, the delay time is set based on the amount of ink applied to the vicinity of the area which the rubber piece 7 contacts. In such embodiments, a method such as directly counting the recording data itself indicating the number of discharging ink droplets from the recording head 1, is used. On the other hand, in the present embodiment, image data for determining a delay time is determined depending on the presence or absence of an image in an area which a rubber piece 7 contacts. For RGB multivalued image data, for example, it is determined in two kinds, that is, whether a predetermined area is "white data" or "others". If a determination result is "white data", i.e., (R, G, B)=(255, 255, 255), and ink is not applied to the predetermined area, the delay time Td is set to Td=0. On the other hand, if the determination result is "others", i.e., ink is applied to the predetermined area, the delay time Td is uniformly set. Alternatively, the presence or absence of character attribute information frequently used in a text image may be determined, and the delay time Td is set to zero if the character attribute information does not exist and the delay time Td is uniformly set if the character attribute information exists.

If the delay time Td is determined based on the RGB image data, the delay time Td may be preferably set longer when a color is used in which soiling is more easily noticeable, e.g., a dense color or a dark color. For example, a threshold value is set to 1 when an RGB value is 128, and is set to 2 when the RGB value is 64 (the color is denser when the threshold value is 2). An image processing unit can output an image determination signal 1 if the threshold value exceeds one, and can output an image determination signal 2 if the threshold value exceeds two, to select the delay time Td.

An embodiment, in the above-described configuration, controls timing at which a pressing member contacts recording media sequentially stacked on a stacking member, in consideration of a fixing state of a recording agent applied onto the recording media. Thus, soiling of an apparatus and an image defect can be suppressed which occurs when an apparatus member makes contacts with the unfixed recording agent applied onto the recording media.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-162210, filed Aug. 22, 2016, which is hereby incorporated by reference herein in its entirety.

What is claimed is:

1. A control apparatus comprising:

an application unit configured to apply a recording agent to a recording medium;

a conveyance unit configured to convey a recording medium to which a recording agent is applied by the application unit;

a stacking member configured to stack recording media which are sequentially conveyed by the conveyance unit;

a pressing member configured to press the recording media which are sequentially stacked on the stacking member; and a control unit configured to control timing at which the pressing member contacts the recording media, wherein the recording media is stacked on the stacking member with a surface of the recording media to which the recording agent is applied facing up, and the pressing member presses an upper surface of the recording medium stacked on the stacking member, and wherein the control unit controls the timing at which the pressing member contacts a recording medium when the recording medium has been stacked on the uppermost recording medium, based on data for applying the recording agent to a predetermined area, on the recording medium, including an area which the pressing member can contact.

2. The control apparatus according to claim 1, wherein the control unit controls the timing based on an amount of the recording agent indicated by the data.

3. The control apparatus according to claim 2, wherein the control unit controls the timing based on a fixing time period during which the recording agent is fixed, and which is acquired based on the amount of the recording agent indicated by the data, and a conveyance time period from when the recording agent is applied to the recording medium by the application unit to when the recording medium is stacked on the stacking member.

4. The control apparatus according to claim 3, wherein the control unit compares the fixing time period and the conveyance time period, and performs control, when the fixing time period is longer than the conveyance time period, to delay the timing by a time period corresponding to a difference between the fixing time period and the conveyance time period, compared to a case where the fixing time period is shorter than the conveyance time period.

5. The control apparatus according to claim 2, wherein the control unit controls the timing such that, in a case where the amount of the recording agent indicated by the data is a first amount, the timing becomes later than the timing in a case where the amount of the recording agent indicated by the data is a second amount which is smaller than the first amount.

6. The control apparatus according to claim 1, wherein the application unit applies the recording agent to the recording media by discharging ink as the recording agent, and wherein the data is binary image data representing discharge or non-discharge of the ink.

7. The control apparatus according to claim 6, wherein the control unit controls the timing by counting the number of data representing the discharge of the ink included in the data.

8. The control apparatus according to claim 1, wherein the control unit further controls the timing based on a speed at which the conveyance unit conveys the recording medium.

9. The control apparatus according to claim 8, wherein, when the conveyance unit conveys the recording medium at a first speed, the control unit controls the timing such that, in a case where the amount of the recording agent indicated by the data is a third amount, the timing becomes later than the timing in a case where the amount of the recording agent indicated by the data is a fourth amount which is smaller than the third amount.

10. The control apparatus according to claim 9, wherein, when the conveyance unit conveys the recording medium at a second speed which is lower than the first speed, the control unit controls the timing such that, in a case where the amount is the third amount, the timing becomes the same as the timing in a case where the amount is the fourth amount which is smaller than the third amount.

11. The control apparatus according to claim 1, wherein the pressing member is a plurality of the pressing members, wherein the predetermined area includes a plurality of areas where the plurality of pressing members respectively contact the recording medium, and wherein the data includes a plurality of data for respectively applying the recording agent to the plurality of areas.

12. The control apparatus according to claim 11, wherein the control unit controls the timing based on a maximum value of amounts of the recording agent respectively indicated by the plurality of data.

13. The control apparatus according to claim 1, wherein the control unit acquires a maximum value of an amount of the recording agent applied per unit area based on the data, and controls the timing based on the maximum value.

14. The control apparatus according to claim 1, wherein the control unit controls the timing based on a result of determination whether the data includes data indicating the application of the recording agent.

15. The control apparatus according to claim 14, wherein, in a case where the data includes the data indicating the application of the recording agent, the control unit controls the timing such that the timing becomes later than the timing in a case where the data does not include the data indicating the application of the recording agent.

16. The control apparatus according to claim 1, wherein the conveyance unit has a configuration in which a front surface and back surface of the recording medium are reversed so that the application unit can apply the recording agent to both the front and back surfaces of the recording medium, and wherein the control unit controls the timing based on data corresponding to the predetermined area and data corresponding to a second area positioned on a rear surface of the predetermined area.

17. The control apparatus according to claim 1, further comprising a sensor configured to detect that the recording medium has passed through a predetermined position and output a signal based on the detection, wherein the control unit controls the timing based on the signal from the sensor.

18. The control apparatus according to claim 1, wherein the pressing member includes an elastic member.

19. The control apparatus according to claim 1, wherein the pressing member is fixed to a rotating shaft and, by rotation of the rotating shaft, contacts the recording media which are sequentially stacked on the stacking member.

20. The control apparatus according to claim 1, wherein the predetermined area includes an area which can contact the pressing member and an area in its vicinity.

21. A control method for a control apparatus having a stacking member and a pressing member, the control method comprising applying a recording agent to a recording medium;

conveying a recording medium to which a recording agent is applied;

stacking, via the stacking member, recording media which are sequentially conveyed;

pressing, via the pressing member, the recording media which are sequentially stacked on the stacking member; and controlling timing at which the pressing member contacts the recording media, wherein the recording media is stacked on the stacking member with a surface of the recording media to which the recording agent is applied facing up, and the pressing member presses an upper surface of the recording medium stacked on the stacking member, and wherein controlling includes controlling the timing at which the pressing member contacts a recording medium when the recording medium has been stacked on the uppermost recording medium, based on data for applying the recording agent to a predetermined area, on the recording medium, including an area which the pressing member can contact.

22. The control method according to claim 21, wherein controlling includes controlling the timing based on an amount of the recording agent indicated by the data.

23. The control method according to claim 21, wherein controlling includes controlling the timing based on a fixing time period during which the recording agent is fixed, and which is acquired based on the amount of the recording agent indicated by the data, and a conveyance time period from when the recording agent is applied to the recording medium to when the recording medium is stacked on the stacking member.

24. The control method according to claim 21, wherein applying includes applying the recording agent to the recording media by discharging ink as the recording agent, and wherein the data is binary image data representing discharge or non-discharge of the ink.

* * * * *